US007169055B2

(12) United States Patent
Mekosh

(10) Patent No.: US 7,169,055 B2
(45) Date of Patent: Jan. 30, 2007

(54) POOL CUE WITH SLIDABLE SLEEVE AND METHOD OF USE THEREOF

(76) Inventor: Peter Mekosh, 298 Jackson Park Dr., Hoschton, GA (US) 30548

( * ) Notice: Subject to any disclaimer, the term of this patent is extended or adjusted under 35 U.S.C. 154(b) by 0 days.

(21) Appl. No.: 11/104,192

(22) Filed: Apr. 12, 2005

(65) Prior Publication Data

US 2006/0229135 A1 Oct. 12, 2006

(51) Int. Cl.
*A63D 15/08* (2006.01)

(52) U.S. Cl. ..... 473/43; 473/46

(58) Field of Classification Search ..... 473/42–51
See application file for complete search history.

(56) References Cited

U.S. PATENT DOCUMENTS

| | | | | |
|---|---|---|---|---|
| 529,731 | A | | 11/1894 | Gschwendtner |
| 870,491 | A | | 11/1907 | Callaghan |
| 2,931,649 | A | | 4/1960 | Furda |
| 3,416,794 | A | | 12/1968 | Ciano |
| 3,534,959 | A | | 10/1970 | Elswick |
| 4,147,346 | A | | 4/1979 | Giannetti |
| 5,238,457 | A | | 8/1993 | Triplett |
| 5,290,030 | A | * | 3/1994 | Medbury ..... 473/47 |
| 5,351,703 | A | * | 10/1994 | Moe et al. ..... 135/77 |
| 5,478,282 | A | | 12/1995 | Possum et al. |
| 5,785,602 | A | * | 7/1998 | Morabito ..... 473/2 |
| 6,042,481 | A | | 3/2000 | Walker et al. |
| 6,066,051 | A | * | 5/2000 | Liu et al. ..... 473/44 |
| 6,113,501 | A | | 9/2000 | Richards |

* cited by examiner

*Primary Examiner*—Mark S. Graham
(74) *Attorney, Agent, or Firm*—Myers & Kaplan LLC; Sandra Drummond, Esq.; Joel D. Myers, Esq.

(57) ABSTRACT

A pool cue comprising a handle with standard taper section, a straight shaft section with tip at the end thereof, and a slidable sleeve disposed on the straight shaft section. An o-ring resides in a groove at the tip to prevent the slidable sleeve from falling off of the pool cue when the tip thereof is pointed downward. The tip o-ring can be detached to permit removal and/or replacement of the sleeve. A plurality of o-rings resides in grooves at the handle end of the straight shaft, approximately at the middle of the pool cue. The o-rings may be of the same diameter as the inner diameter of the sleeve, or alternately, slightly larger than the inner diameter of the sleeve, wherein the o-rings increase in diameter towards the handle. The sleeve can be positioned over the plurality of o-rings, wherein it is retained either by friction or interference.

11 Claims, 2 Drawing Sheets

POOL CUE WITH SLIDABLE SLEEVE AND METHOD OF USE THEREOF

TECHNICAL FIELD

The present invention relates generally to pool sticks or cues, and more specifically to a pool cue having a tubular slidable sleeve, wherein the slidable sleeve moves over a defined section of the cue to facilitate execution of a smooth pool stroke. The slidable sleeve is retained on the cue via an o-ring or similar device disposed within a groove near the tip of the cue. Additionally, there are several o-rings disposed proximate to the handle end of the pool stick to enable convenient securing of the slidable sleeve when its use is not required.

BACKGROUND OF THE INVENTION

During the play of a game of pool, a player strokes a cue ball with a pool or cue stick. The pool cue typically has a long, tapered conical shape, wherein the tip is of narrow diameter and the handle is of large diameter, suitable for gripping by a player with his/her hand. The handle of the pool cue is held in the player's thrusting hand, while a front portion of the pool cue shaft lies between the thumb and forefinger of the player's immobile hand (or 'bridge' hand), or is retained in a curled forefinger thereof, thereby providing rigid support for the shaft of the cue.

Occasionally, a bridge device is utilized in place of the player's immobile hand when it is difficult to make a smooth pool stroke, or to provide support to the front portion of the shaft when the player has difficulty placing his/her immobile hand in close proximity to the cue ball. Although such bridge devices provide support, the pool cue shaft may still leave the confines of the bridge during the player's stroke.

As the pool stroke is made, the pool cue moves forward. During execution of the thrusting stroke with a standard pool cue, the increasing diameter of the pool cue shaft moving against the fixed position of the player's bridge hand causes the tip of the pool cue to rise as the tip approaches the cue ball. Such a rise in position of the tip can lead to topspin being imparted on the cue ball, thereby increasing the distance that the cue ball will travel, or striking of the target ball by the cue ball at a higher level of force than desired. In addition, movement of the cue tip upwards can cause a miscue, wherein the tip of the pool cue does not strike the cue ball on center and tends to move the cue ball by frictional forces imparted from the side of the shaft rather than the tip thereof.

Often during play, the pool cue acquires perspiration from the player's hand, liquid from a beverage, or other foreign matter that can impede the smooth stroke of the cue. During such occasions, the pool cue may become too slippery, or alternately, if the foreign matter is sticky, the cue may be impeded during its stroke, leading to a poorly-directed stroke and/or a miscue. When the cue is impeded, the player will often overcorrect and impart greater thrust to the pool cue. However, once friction is overcome, the pool cue will travel under this greater force and strike the cue ball harder than intended. In addition, the tissue of the bridge hand may yield under the increased force, thereby redirecting the intended trajectory of the pool cue.

Accordingly, various devices and methods have been utilized in an attempt to provide a smooth pool stroke. For instance, one invention utilizes a pool cue sleeve, wherein the sleeve is slidably engaged over a straight section of the pool cue shaft, and wherein the tip end of the shaft mushrooms to a width greater than the width of the shaft to prevent withdrawal of the sleeve therefrom. The device also permits securing the sleeve out of the way on a single ring member. However, when the sleeve is no longer desired, such a pool cue does not permit the subsequent removal of the sleeve from the pool cue such as via passage over the tip end. Furthermore, in the event that the existing sleeve becomes damaged or otherwise unsuited for further use the inability to remove the sleeve prevents replacement of same.

Still other inventions utilizing a sleeve device do not provide a means for retaining the sleeve on the pool cue, thereby resulting in the sleeve falling off of the pool cue when the cue is pointed in a downward direction.

Therefore, it is readily apparent that there is a need for a pool cue with a slidable sleeve and method of use thereof, wherein the sleeve is removably retained upon the pool cue, thereby permitting selective use, removal and/or replacement of same. The device further provides a smooth stroke irrespective of hand perspiration, thereby providing an even and controlled stroke.

BRIEF SUMMARY OF THE INVENTION

Briefly described, in a preferred embodiment, the present invention overcomes the above-mentioned disadvantages and meets the recognized need for such a device by providing a pool cue having a sleeve member slidable over a defined uniform-thickness section of the pool cue to facilitate a controlled, smooth stroke.

According to its major aspects and broadly stated, the present invention in its preferred form is a pool cue with a slidable sleeve and method of use thereof, wherein the pool cue has a slidably-engaged sleeve removably secured thereto via a blocking o-ring disposed at the tip end of the pool cue. That is, the blocking o-ring resides in a groove formed at the tip of the pool cue and is removable therefrom to enable extraction of the sleeve from the pool cue. As such, replacement sleeves can be installed upon the pool cue, or the sleeve can be removed altogether. The pool cue further comprises o-rings to retain the slidable sleeve when it is not being utilized.

In use, the sleeve member is gripped by the player in his/her bridge hand, allowing the player to effortlessly slide the cue back-and-forth within the sleeve with his/her thrusting hand. The use of the sleeve facilitates control of linear movement of the pool cue, preventing lateral movement thereof, and thus permitting smooth stroking of the pool cue to ensure accurately directed pool shots. Additionally, the sliding sleeve significantly reduces friction, because the hard interior surface of the sleeve is in contact with the hard exterior surface of the pool cue.

More specifically, the present invention is a slidable sleeve pool cue and method of use thereof, wherein the pool cue comprises a handle with standard taper section, a straight shaft section with tip at the end thereof, and a slidable sleeve disposed on the straight shaft section. A removable o-ring prevents the slidable sleeve from falling off when the tip of the pool cue is pointed downward, yet the o-ring can be detached to permit removal and/or replacement of the slidable sleeve. A plurality of o-rings, preferably three, resides in grooves at the handle end of the straight shaft (i.e., approximately at the middle of the pool cue). The o-rings may be of the same diameter as the inner diameter of the sleeve, or alternately, slightly larger than the inner diameter of the sleeve, wherein the o-rings increase in diameter towards the handle. The sleeve can be positioned over the plurality of o-rings, where it is retained either by friction or interference.

In use, the slidable sleeve is held with the bridge hand of the player, thereby preventing unintended or incidental lateral movement or other movement in a non-linear direction that could detrimentally affect the aim of the player. Because the slidable sleeve can be retained securely by the bridge hand, the use of the slidable sleeve further overcomes the disadvantages of using a bridge cue, wherein the pool cue could otherwise leave the confines of the bridge cue during performance of a pool stroke. That is, during play, the slidable sleeve provides a rigid structure to maintain the straight intended course of the pool cue therethrough. As such, instead of resulting in inaccurate delivery of the stroke at the point of impact with the ball as is the case with a standard pool cue, the tip of the pool cue will strike the cue ball where intended and result in an accurately placed pool shot. Furthermore, any moisture on the cue or the bridge hand will have no effect on the pool stroke, since the shaft rides within the solid surface of the sleeve.

Accordingly, a feature and advantage of the present invention is its ability to prevent binding of a pool cue when making a pool shot.

Another feature and advantage of the present invention is its ability to enable accurate pool shots.

Still another feature and advantage of the present invention is its ability to selectively disengage the sleeve member.

Yet another feature and advantage of the present invention is its ability to provide a smooth, precise and consistent pool stroke.

Yet still another feature and advantage of the present invention is its ability to permit removal, substitution and/or replacement of the sleeve member.

A further feature and advantage of the present invention is that it provides proper support and guidance of the pool or billiard cue by the 'bridge' hand of the player.

Yet still a further feature and advantage of the present invention is that it facilitates learning by beginners, thereby allowing beginners to play a at a more advanced level than would be possible without the present sliding sleeve.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

In describing the preferred and selected alternate embodiments of the present invention, as illustrated in FIGS. 1–4, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
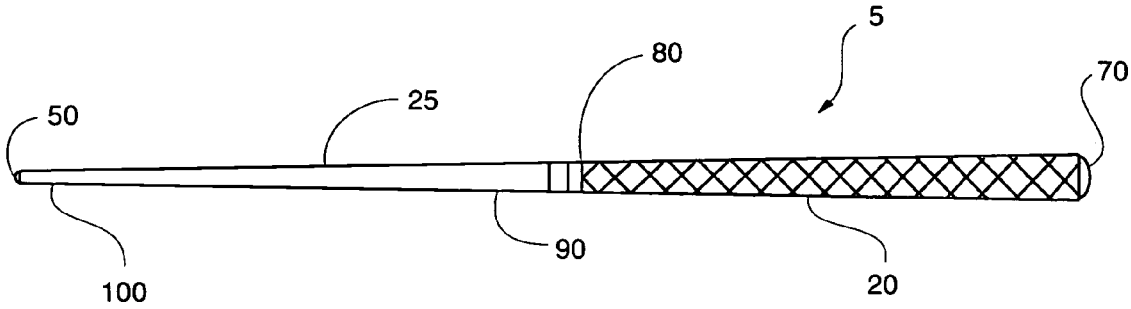
FIG. 1 (PRIOR ART)
FIG. 1 is a side view of a pool cue according to a prior art device.

Referring now to FIG. 1, depicted therein is prior art device 5, wherein prior art device 5 comprises handle 20, wherein handle 20 is generally conical or tapered in shape, tapered shaft 25, and tip 50. Handle 20 comprises bumper 70, center 80, and tapered shaft 25.

Figure 2:
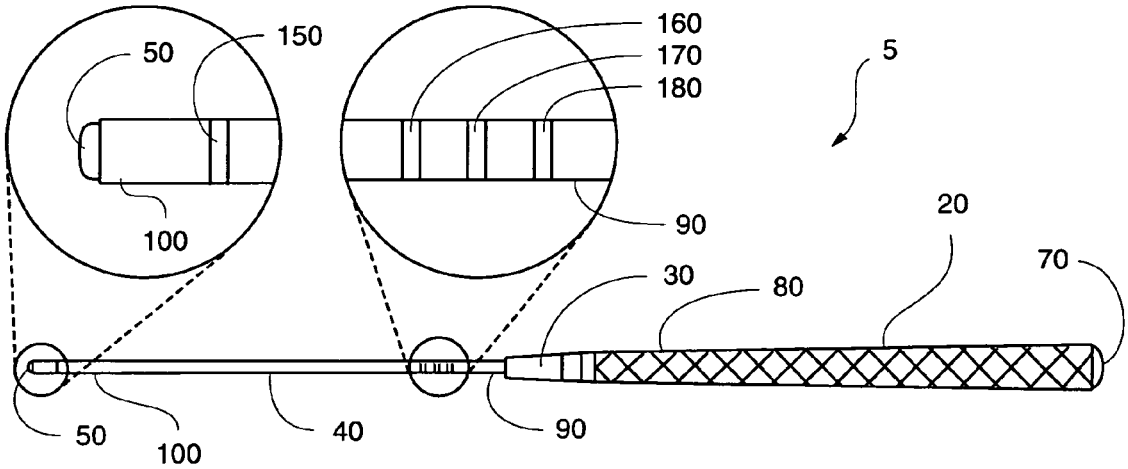
FIG. 2 is a side view of a pool cue according to a preferred embodiment of the present invention, prior to installation of a slidable sleeve.
Figure 3:
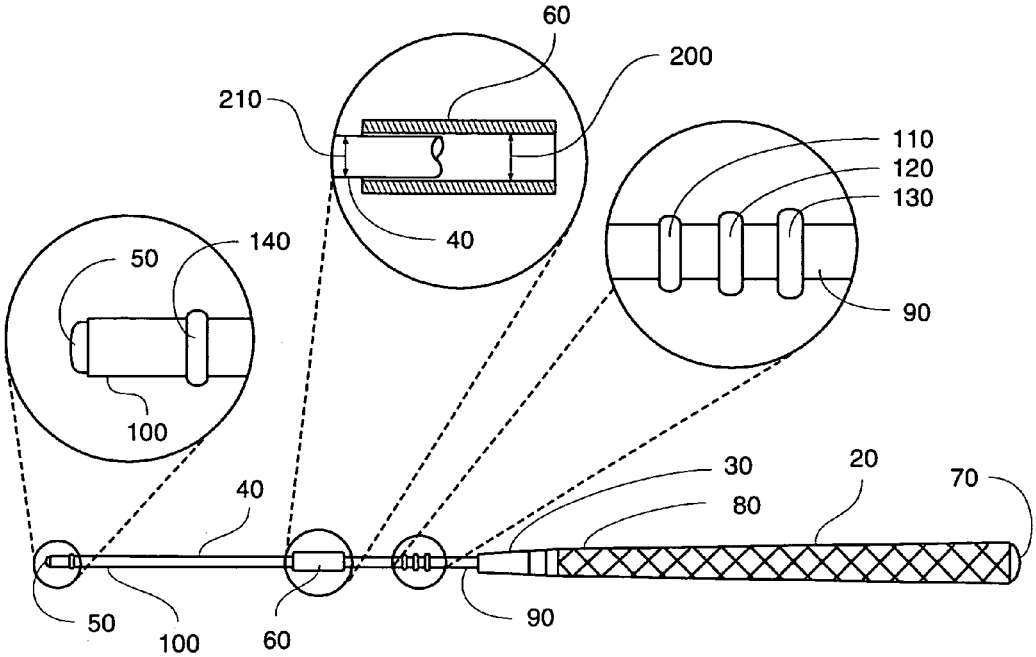
FIG. 3 is a side view of a pool cue according to a preferred embodiment of the present invention, after installation of a slidable sleeve; and, FIG. 4 is a perspective view of a pool cue according to a preferred embodiment of the present invention, shown in use.
Figure 4:
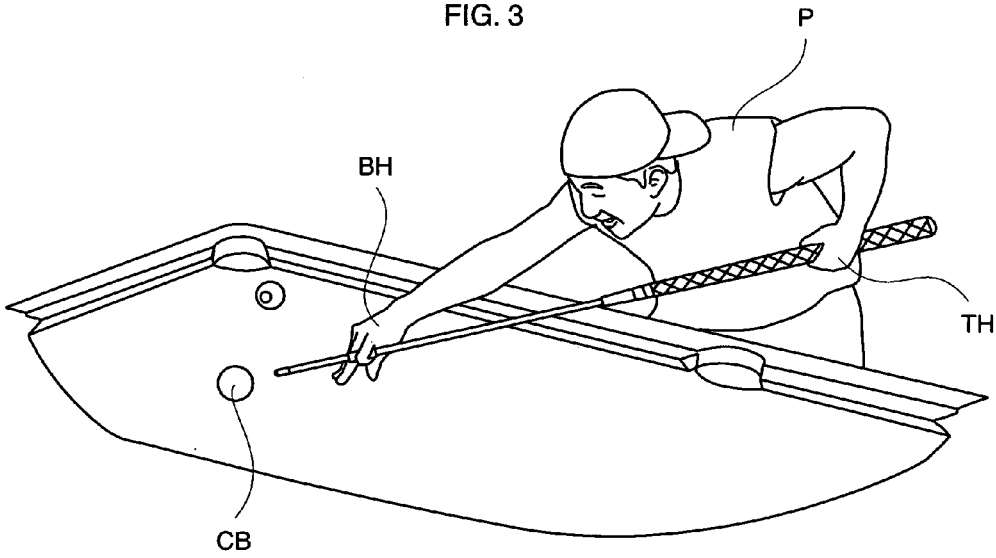

Referring now to FIGS. 2–4, the present invention in a preferred embodiment is pool cue 10 comprising handle 20, taper 30, straight shaft 40, tip 50 and sleeve 60. Handle 20 preferably comprises bumper 70 and center 80, and straight shaft 40 preferably comprises first end 90 and second end 100. Straight shaft 40 is preferably of a suitable length to permit adequate length of stroke through sleeve 60, such as, for exemplary purposes only, approximately half the length of pool cue 10. Straight shaft 40 further preferably comprises annular tip groove 150 disposed at second end 100, and first annular groove 160, second annular groove 170 and third annular groove 180, wherein grooves 160, 170, 180 are preferably disposed at first end 90.

Sleeve 60 is preferably of a width suitable for resting in bridge hand BH of player P. It will be recognized by those skilled in the art that sleeve 60 could be substantially longer than bridge hand BH, or substantially shorter if retained via curled fingers of bridge hand BH. Sleeve 60 is rigid to prevent bending thereof, as bending could result in binding of sleeve 60 on straight shaft 40. Sleeve 60 preferably has inner diameter 200 slightly greater than diameter 210 of straight shaft 40, wherein the difference between inner diameter 200 and diameter 210 is at least one-thousandth of an inch; however, any suitable difference in diameter sufficient to enable slidable movement of sleeve 60 over shaft 40 may alternately be employed.

First o-ring 110, second o-ring 120 and third o-ring 130 are preferably disposed on straight shaft 40 at first end 90 thereof, proximate taper 30, wherein o-rings 110, 120 and 130 are preferably suitably spaced apart by at least approximately their own diameter. O-rings 110, 120, 130 are preferably retained in annular grooves 160, 170, 180, respectively, formed at first end 90 of straight shaft 40.

Blocking o-ring 140 is preferably disposed at second end 100 of straight shaft 40, wherein blocking o-ring 140 is preferably retained in annular tip groove 150, and wherein blocking o-ring 140 preferably has a diameter approximately equal to outer diameter 190 of sleeve 60.

To prepare for use, blocking o-ring 140 is preferably removed from annular tip groove 150 and separated from pool cue 10, wherein sleeve 60 is preferably subsequently placed over straight shaft 40 by insertion of tip 50 through sleeve 60. Blocking o-ring 140 is then preferably replaced on straight shaft 40 within annular tip groove 150, thereby retaining sleeve 60 on straight shaft 40.

When sleeve 60 is not required, it is preferably moved into frictional retention on first o-ring 110, or for more secure retention onto second o-ring 120 or third o-ring 130. O-rings 110, 120, 130 can selectively be of the same size, or alternately, of increasing size.

When o-rings 110, 120, 130 are selected to be of the same size, positioning of sleeve 60 over o-rings 110, 120, 130 preferably provides additional gripping surface to immobilize sleeve 60 thereupon. Utilizing increasingly larger diameter o-rings 110, 120, 130 preferably provides increased interference between o-rings 110, 120, 130 and sleeve 60, preferably resulting in tighter retention of sleeve 60 upon o-rings 110, 120, 130.

Referring now more particularly to FIG. 4, depicted therein is pool cue 10 being utilized by a pool player P. Sleeve 60 is preferably retained on or by bridge hand BH of player P, wherein player P preferably grips handle 20 proximate bumper 70 with thrusting hand TH. Player P preferably moves pool cue 10 in a forward direction, wherein straight shaft 40 preferably passes smoothly forward via sleeve 60, and wherein tip 50 impinges upon cue ball CB in a selected location thereon. When player P wishes to make a stroke without using sleeve 60, such as when utilizing a separate bridging device, player P preferably slides sleeve 60 out of the way upon o-rings 110, 120, 130.

It is envisioned in an alternate embodiment of the present invention that o-rings 110, 120, 130 and/or 140 could be retained on straight shaft 40 without utilizing annular grooves 160, 170, 180 and/or 150, respectively.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A pool cue comprising:

a slidable sleeve;

a removable means for preventing passage of said slidable sleeve thereover, whereby said slidable sleeve is retained on said pool cue, a uniform-diameter section, having at least one retention groove, said removable means comprising at least one o-ring, wherein said at least one o-ring is secured in said at least one retention groove; and wherein said at least one retention groove and said at least one o-ring are disposed at a tip end of said pool cue.

2. A pool cue comprising:

a slidable sleeve;

a removable means for preventing passage of said slidable sleeve thereover, whereby said slidable sleeve is retained on said pool cue; and at least one o-ring disposed on a uniform diameter shaft of said pool cue proximate a handle end of said uniform-diameter shaft, wherein said at least one o-ring comprises a plurality of o-rings of increasing diameter.

3. The pool cue of claim 2, wherein said removable means comprises an o-ring.

4. The pool cue of claim 2, wherein said slidable sleeve is retained on said pool cue via a first o-ring disposed at a tip end of said pool cue.

5. The pool cue of claim 2, further comprising a first retention groove.

6. The pool cue of claim 5, wherein said removable means is secured within said first retention groove.

7. A method of playing pool, said method comprising the steps of:

a. obtaining a pool cue comprising a pool cue shaft comprising a tip end, a slidable sleeve, and an o-ring means for retaining said slidable sleeve;

b. supporting said slidable sleeve on a player's bridge hand;

c. immobilizing said slidable sleeve on a plurality of increasing-sized o-rings; and d. performing a pool stroke utilizing said pool cue.

8. The method of claim 7, further comprising the steps of:

detaching said o-ring means for retaining; and removing said slidable sleeve.

9. The method of claim 7, further comprising the steps of:

detaching said o-ring means for retaining; and replacing said slidable sleeve.

10. A billiard cue comprising:

a shaft comprising a tip end;

a slidable sleeve;

a removable first o-ring, wherein said slidable sleeve is retained on said pool cue shaft by said removable first o-ring, and wherein said removable first o-ring is disposed at said tip end of said pool cue shaft; and a plurality of second o-rings disposed on said shaft, wherein said second o-rings are adapted to retain said slidable sleeve immobilized thereon.

11. The billiard cue of claim 10, wherein said second o-rings comprise increasing-sized o-rings.

* * * * *